US005102365A

United States Patent [19]

Wang

[11] Patent Number: 5,102,365

[45] Date of Patent: Apr. 7, 1992

[54] INFLATABLE ARTICLE

[75] Inventor: Cheng-Chung Wang, Taipei Hsien, Taiwan

[73] Assignee: Team Worldwide Corp., Hsin Tien, Taiwan

[21] Appl. No.: 681,989

[22] Filed: Apr. 8, 1991

[51] Int. Cl.[5] ..... A63H 27/10

[52] U.S. Cl. ..... 446/221; 446/220; 273/58 B; 273/58 BA

[58] Field of Search ..... 446/221, 220, 224–226; 273/58 R, 58 B, 58 BA; 5/441, 456; 244/31, 32, 33

[56] References Cited

U.S. PATENT DOCUMENTS

| | | | |
|---|---|---|---|
| 2,463,517 | 3/1949 | Chromak | 446/220 X |
| 4,172,301 | 10/1979 | Everard et al. | 5/456 |
| 4,268,030 | 5/1981 | Richards | 446/226 X |
| 4,335,536 | 6/1982 | Magid et al. | 446/224 X |

FOREIGN PATENT DOCUMENTS

| | | | |
|---|---|---|---|
| 390690 | 4/1933 | United Kingdom | 273/58 BA |

*Primary Examiner*—Mickey Yu
*Attorney, Agent, or Firm*—Morrison Law Firm

[57] ABSTRACT

Disclosed is an inflatable ball including at least an upper layer, a lower layer and an intermediate layer of flexible sheets, which are overlapped and heat-sealed together along their circumferences so as to form an inflatable upper chamber between the upper and intermediate layers, and an inflatable lower chamber between the lower and intermediate layers. The intermediate layer is made to contract in its heat-sealed circumference after heat sealing, thus obtaining an improved inflatable ball which requires smaller inflation pressure, and which results in smaller deformation in its upper and lower layers in an inflated state.

11 Claims, 5 Drawing Sheets

50

60

INFLATABLE ARTICLE

BACKGROUND OF THE INVENTION

The present invention relates generally to an improved inflatable article such as an inflatable ball, and particularly to an inflatable ball which can be inflated by smaller inflating pressure and which, when inflated, results in less deformation on its outer surface, thus reducing distortion of the words and patterns printed on the outer surface of the inflatable ball.

A typical example of a conventional inflatable ball is shown in FIG. 1. It comprises a plurality of side pieces 1 which are arranged and sealed side by side, a top piece 2, a bottom piece 3, and an inflation valve 4. Side pieces 1, top piece 2 and bottom piece 3 are all made of airtight, flexible thermoplastic materials so that they may be heat-sealed to one another. Usually the number of side pieces required for constituting an inflatable ball is eight or six. Since many working steps are necessary for forming such an inflatable ball, the production process is quite complicated and, consequently, the production cost is relatively high.

In view of the above-described drawbacks of the inflatable ball shown in FIG. 1, another type of inflatable ball as shown in FIG. 2 (in deflated state), and FIG. 3 (in an inflated state) has been proposed. As illustrated in these two figures, this inflatable ball comprises only three layers, namely an upper layer 21, an intermediate layer 22 and a lower layer 23 of thermoplastic sheets which are of similar elastic moduluses and are overlapped and heat-sealed along their circumferences. Several vent holes 25 are provided in intermediate layer 22, and an inflation valve 24 is mounted in upper layer 21 for inflating the inflatable ball. When a user (especially, a child) tries to inflate such an infatable ball by mouth, he will usually find it very difficult to inflate the inflatable ball into a really spherical shape due to the resistance of the upper layer and lower layer upon being inflated. Instead, the inflated ball will become a final shape as shown in FIG. 3, which is flattened to some extent as compared with a really spherical shape.

FIG. 4 shows yet another type of inflatable ball also comprising three layers, namely an upper layer 41, an intermediate layer 42 and a lower layer 43 of thermoplastic sheets, among which upper layer 41 and lower layer 43 are formed by material having smaller elastic modulus as compared with intermediate layer 42. As can be seen in FIG. 4, though the final shape of such a ball in an inflated state is nearer to a real sphere, as compared with FIG. 3, due to its weaker restoring (resisting) force against inflation, part of the material in the central region B of upper layer 41 tends to move radially outward toward its peripheral region A upon inflation. This material movement makes the thickness of the upper layer 41 non-homogeneous, thinner in central region B and thicker in peripheral region A similar situation occurs in the lower layer 43. Thus, in an inflated state, the inflatable ball is apt to break in the central region B of upper layer 41 or lower layer 43, and words or patterns printed on the outer surface of the ball will be greatly distorted in the same region B.

SUMMARY OF THE INVENTION

In view the drawbacks of the above-described, several types of conventional inflatable articles and particularly inflatable balls, the primary object of the present invention is to provide an improved inflatable ball which can be inflated into an approximately spherical shape by means of a smaller inflation pressure.

Another object of the present invention is to provide an improved inflatable article which can be manufactured by a simple process, thus reducing the production cost.

In accordance with the present invention, an inflatable article includes at least an upper layer, a lower layer and an intermediate layer of flexible sheets, which are overlapped and heat-sealed together along their circumferences so as to form an inflatable upper chamber between the upper and intermediate layers, and an inflatable lower chamber between the lower and intermediate layers. The intermediate layer is made to contract in its heat-sealed circumference after heat sealing, thus obtaining an improved inflatable ball which requires smaller inflation pressure, and results in smaller deformation in its upper and lower layers in an inflated state.

BRIEF DESCRIPTION OF THE DRAWINGS

The present invention can be more fully understood by referring to the following description and accompanying drawings, which form an integral part of this application.

DETAILED DESCRIPTION OF THE PREFERRED EMBODIMENTS

FIGS. 5 through 8B show inflatable balls in accordance with four embodiments of the present invention.

Each illustrated inflatable ball comprises three layers of overlapping and heat-sealed flexible sheets. The flexible sheets maybe for example, rubber or a plastic such as, for example, polyvinyl chloride (PVC). The common characteristic for the four embodiments is that an intermediate layer alone is made to contract in its heat-sealed circumference after being heat-sealed so as to reduce the inflation pressure required for inflating the inflatable ball and to reduce the deformation, in an inflated state, of the flexible sheets other than the intermediate layer.

Figure 1:
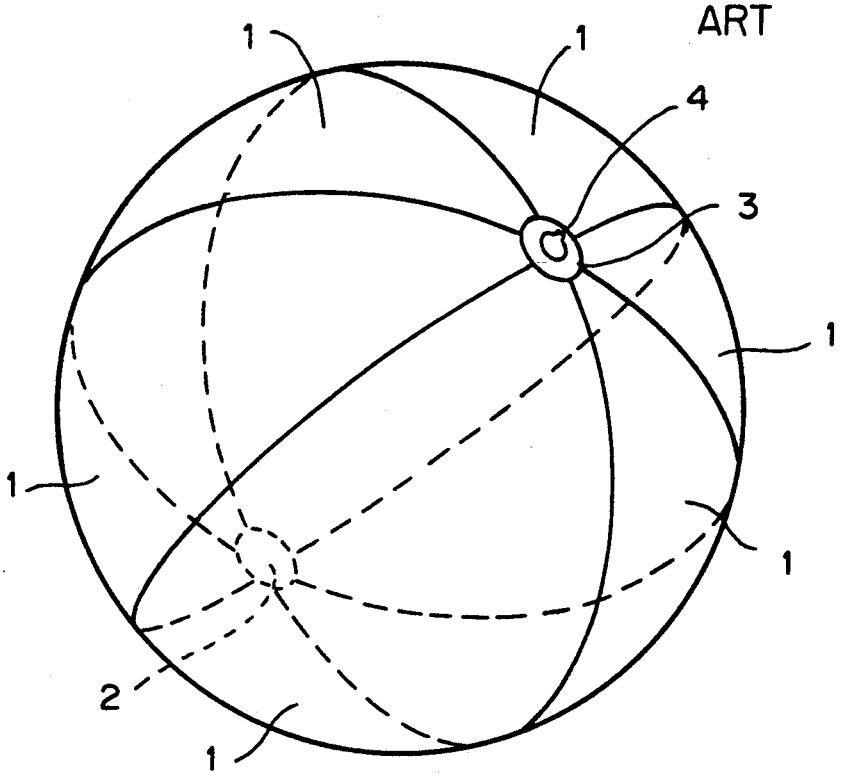
FIG. 1 PRIOR ART
FIG. 1 is a perspective view of a conventional inflatable ball.
Figure 2:
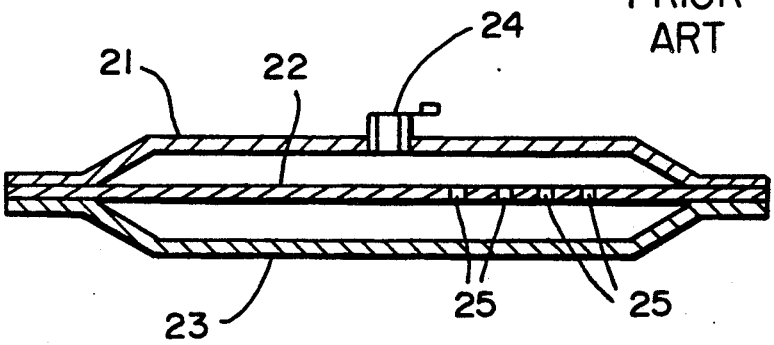
FIG. 2 PRIOR ART
FIG. 2 is a cross-sectional view of another conventional inflatable ball in a deflated state.
Figure 3:
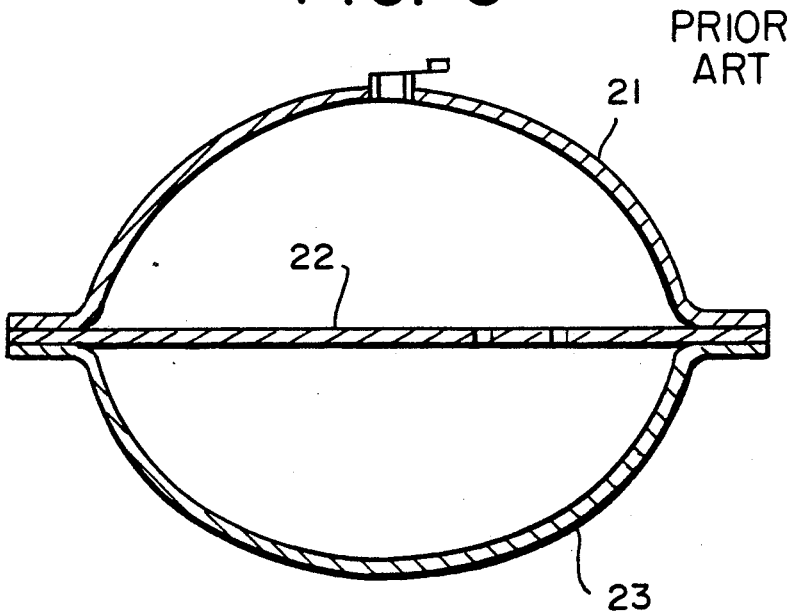
FIG. 3 is a cross-sectional view of the inflatable ball shown in FIG. 2, except that the inflatable ball is shown in an inflated state.
Figure 4:
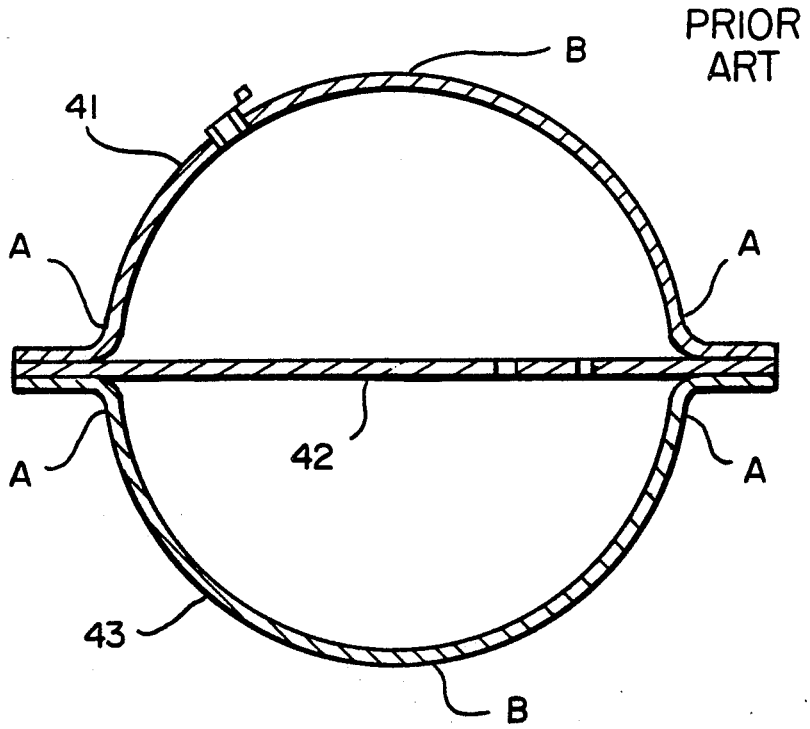
FIG. 4 is a cross-sectional view similar to FIG. 3, however the upper and lower layers constituting the ball have smaller elastic modulus than the intermediate layer.
Figure 5:
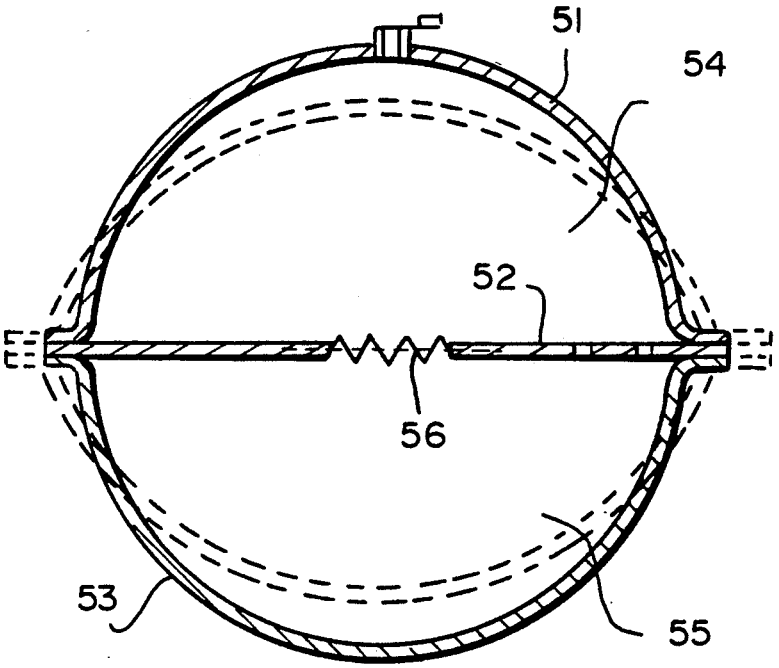
FIG. 5 is a cross-sectional view of an inflatable ball in accordance with a first embodiment of the present invention.

FIG. 5 shows an inflatable ball 50 in accordance with a first embodiment of the present invention. This inflatable ball 50 comprises an upper layer 51, a lower layer 53, and an intermediate layer 52 between upper layer 51 and lower layer 53. The three layers 51, 52 and 53 are heat-sealed together along their circumferences so as to form an inflatable upper chamber 54 between upper layer 51 and intermediate layer 52, and an inflatable lower chamber 55 between lower layer 53 and intermediate layer 52. Intermediate layer 52 includes, within its heat-sealed circumference, a thermal contracting portion 56 formed by thermal contracting material which may be made to contract by heating the inflatable ball after heat-sealing.

Figure 6:
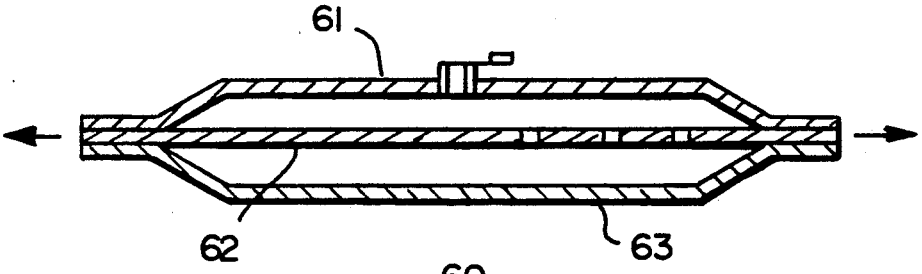
FIG. 6 is a cross-sectional view of an inflatable ball in accordance with a second embodiment of the present invention.

FIG. 6 shows an inflatable ball 60 in accordance with a second embodiment of the present invention. This inflatable ball 60 also comprises an upper layer 61, a lower layer 63, and an intermediate layer 62 between upper layer 61 and lower layer 63. The three layers 61, 62 and 63 are heat-sealed together along their circumferences when intermediate layer 62 alone is in an expanded state. Under the action of restoring force, intermediate layer 62 will contract when released from the expanded state after heat-sealing.

Figure 7A:
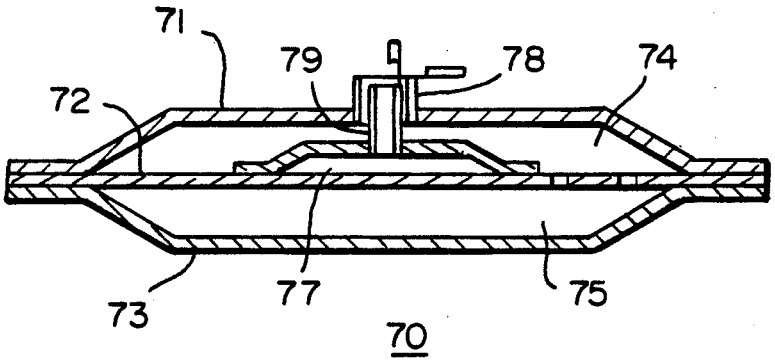
FIG. 7A is a cross-sectional view of an inflatable ball, deflated, in accordance with a third embodiment of the present invention.
Figure 7B:
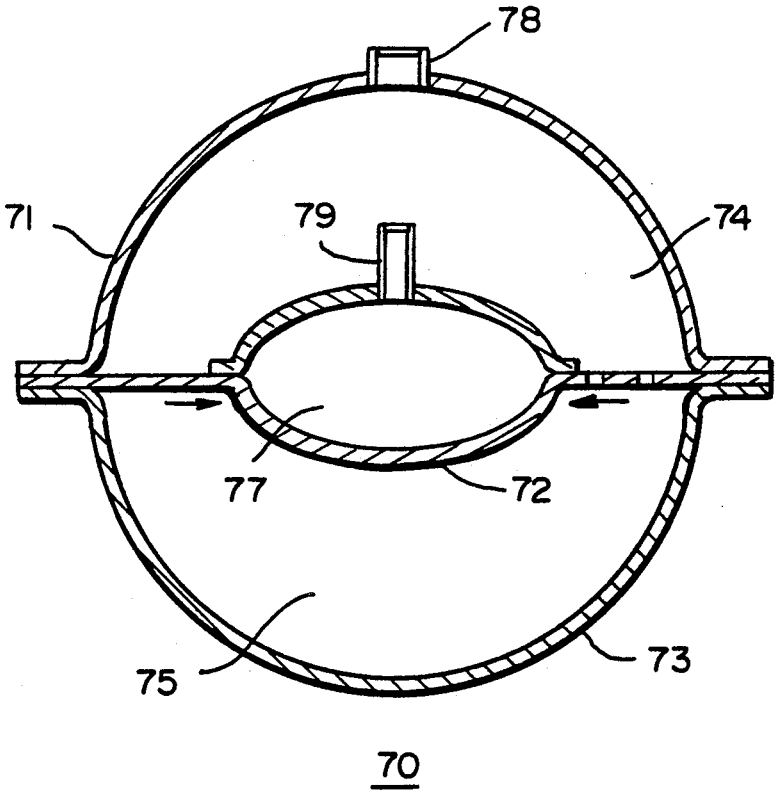
FIG. 7B is a cross-sectional view of the inflatable ball shown in FIG. 7A, with the inflatable ball shown in an inflated state.

FIGS. 7A and 7B show an inflatable ball 70 in accordance with a third embodiment of the present invention. This inflatable ball 70 includes an upper layer 71, a lower layer 73, and an intermediate layer 72 between upper layer 71 and lower layer 73. The three layers 71, 72 and 73 are heat-sealed together along their circumferences so as to form an inflatable upper chamber 74 between upper layer 71 and intermediate layer 72, and an inflatable lower chamber 75 between lower layer 73 and an inflatable lower chamber 75 between lower layer 73 and intermediate layer 72. This inflatable ball 70 also includes a main inflation valve 78 adapted to inflate upper chamber 74 and lower chamber 75, an auxiliary chamber 77 attached to intermediate layer 72, and an auxiliary inflation valve 79 adapted to inflate auxiliary chamber 77. When inflatable ball 70 is in an deflated state a shown in FIG. 7A, auxiliary inflation valve 79 partially protrudes to the outside of inflatable ball 70 through main inflation valve 78 to facilitate the inflation of auxiliary chamber 77, prior to the inflation of upper and lower chambers 74, 75 by use of main inflation valve 78, so as to contract the circumference of intermediate layer 72. The totally inflated state of inflatable ball 70 is shown in FIG. 7B.

Figure 8A:
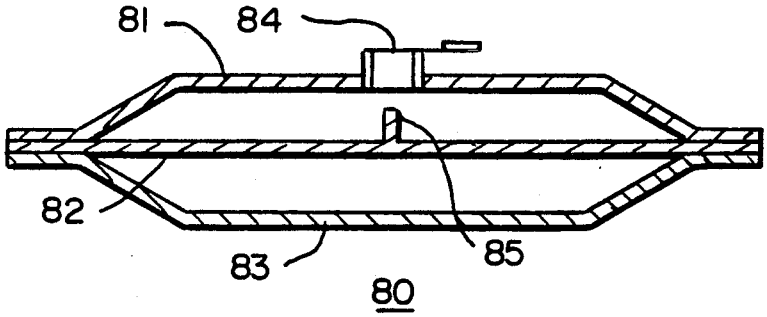
FIG. 8A is a cross-sectional view of an inflatable ball in accordance with a fourth embodiment of the present invention.
Figure 8B:
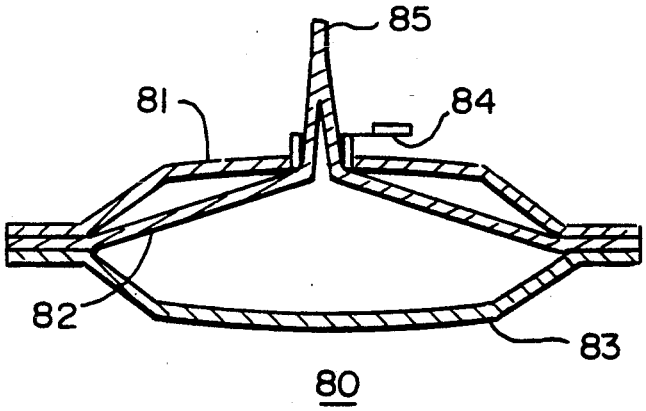
FIG. 8B is a cross-sectional view of the same inflatable ball similar to FIG. 8A, but the circumference of intermediate layer is contracted after heat-sealing by partially pulling the intermediate layer outside through a main inflation valve installed in upper layer of the inflatable ball and then partially tying or the gathering intermediate layer.
Figure 8C:
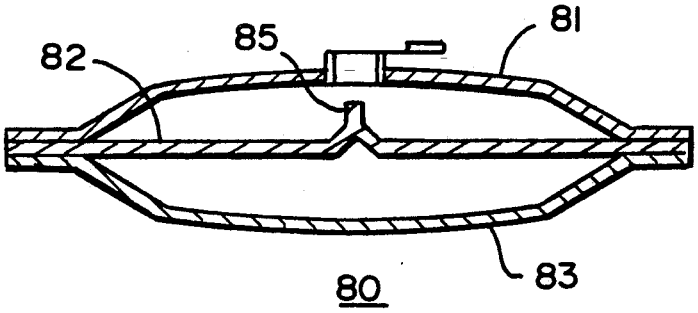
FIG. 8C is a cross-sectional view of the same inflatable ball similar to FIG. 8B, when the partially tied gathered portion of intermediate layer is released and retracts back to the inside of the inflatable ball.

FIGS. 8A, 8B and 8C show another inflatable ball 80 in accordance with a fourth embodiment of the present invention. This inflatable ball 80 includes an upper layer 81, a lower layer 83, an intermediate layer 82 between upper layer 81 and lower layer 83, an inflation valve 84 installed in upper layer 81, and a protrusion 85 formed in the intermediate layer at the location under the inflation valve 84. At first, the three layers 81, 82 and 83 are heat-sealed together along their circumferences. Then, as shown in FIG. 8B, intermediate layer 82 is gripped at protrusion 85 and partially pulled outside of the inflatable ball through inflation valve 84 so as to tie or gather the portion of intermediate layer near protrusion 85, thus contracting the circumference of intermediate layer 82. Finally, the tied or gathered portion of intermediate layer 82 is released and retracts back to the inside of the inflatable ball 80 as shown in FIG. 8C.

While the invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An inflatable article comprising:

at least three layers of overlapping flexible sheets:

said at least three layers including an upper layer, a lower layer and an intermediate layer disposed between said upper and said lower layers;

said st least three layers affixed to each other along peripheral edges thereof;

the intermediate layer separating said article into an upper chamber and a lower chamber;

said intermediate layer including means for contraction within said peripheral edges;

said means for contraction reducing a pressure required for inflation; and said means for contraction reducing deformation of said upper and said lower layers when said upper chamber and said lower chamber are inflated.

2. The inflatable article of claim 1, wherein said intermediate layer is a thermally contracting material and is contracted by heat applied thereto.

3. The inflatable article of claim 2, wherein said intermediate layer includes elastic means for contraction when said edges of said layers are sealed together.

4. The inflatable article of claim 1, further comprising:

a main inflation valve;

said main inflation valve allowing inflation of said upper chamber and said lower chamber;

an auxiliary chamber on said intermediate layer;

an auxiliary valve allowing inflation of said auxiliary chamber;

said auxiliary valve being disposed within said main inflation valve with said upper chamber, said lower chamber and said auxiliary chambers deflated; and said auxiliary chamber including means for contracting said intermediate layer when inflated.

5. The inflatable article of claim 1, wherein:

at least one of said upper and said lower layers includes a main inflation valve;

means by which a central portion of said intermediate layer may be drawn through said inflation valve with said upper and said lower chambers being deflated so as to gather together a portion of the intermediate layer; and means for tying the gathered together portion of the intermediate layer to effect contraction of said intermediate layer.

6. An inflatable article as described in claim 5 wherein said at least three layers formed of a flocking treated material.

7. An inflatable article as described in claim 1, wherein said inflatable article is a spherical inflatable ball.

8. An inflatable article as described in claim 1, wherein said inflatable article is a non-spherical inflatable ball.

9. An inflatable article as described in claim 1, wherein said at least three layers are formed of rubber.

10. An inflatable article as described in claim 1, wherein said at least three layers are formed of PVC material.

11. The inflatable article of claim 1, wherein:

one of said upper and said lower layers includes an inflation valve;

said inflation valve allowing inflation of said upper chamber and said lower chamber;

means for drawing a central portion of said intermediate layer through said inflation valve with said upper and said lower chambers being deflated; and said means for drawing enabling said means for contraction.

* * * * *